US008066476B2

(12) United States Patent
Orban et al.

(10) Patent No.: US 8,066,476 B2
(45) Date of Patent: Nov. 29, 2011

(54) ELECTRICAL SUBMERSIBLE PUMP STAGE CONSTRUCTION

(75) Inventors: Jacques Orban, Moscow (RU); Mikhail Gotlib, Moscow (RU); David Eslinger, Collinsville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 969 days.

(21) Appl. No.: 11/831,070

(22) Filed: Jul. 31, 2007

(65) Prior Publication Data

US 2008/0031731 A1 Feb. 7, 2008

(30) Foreign Application Priority Data

Aug. 2, 2006 (RU) ..... 2006127952

(51) Int. Cl.

| | |
|---|---|
| ***F01D 1/02*** | (2006.01) |
| ***F04D 29/02*** | (2006.01) |
| ***F04D 29/60*** | (2006.01) |
| ***F04D 29/62*** | (2006.01) |

(52) U.S. Cl. ..... 415/196; 415/199.1; 415/199.2; 415/211.2

(58) Field of Classification Search ..... 415/199.1, 415/199.2, 211.2, 196; 416/231 B
See application file for complete search history.

(56) References Cited

U.S. PATENT DOCUMENTS

| | | | | |
|---|---|---|---|---|
| 3,375,789 | A * | 4/1968 | Easton | 415/199.3 |
| 4,428,717 | A * | 1/1984 | Catterfeld | 416/186 R |
| 4,678,399 | A | 7/1987 | Vandevier et al. | |
| 4,741,668 | A | 5/1988 | Bearden | |
| 4,781,531 | A | 11/1988 | James | |
| 5,516,360 | A | 5/1996 | Normandeau et al. | |
| 6,068,444 | A | 5/2000 | Sheth | |
| 6,176,680 | B1 * | 1/2001 | Ringblom et al. | 416/212 R |
| 6,565,257 | B1 | 5/2003 | Kennedy et al. | |
| 6,979,174 | B2 | 12/2005 | Watson et al. | |
| 2005/0074330 | A1 | 4/2005 | Watson et al. | |
| 2006/0204359 | A1 | 9/2006 | Semple et al. | |
| 2009/0016895 | A1 * | 1/2009 | Beez et al. | 416/241 R |

FOREIGN PATENT DOCUMENTS

| | | |
|---|---|---|
| DE | 19742023 A1 * | 3/1999 |
| RU | 2244090 | 1/2005 |
| RU | 2244090 C1 | 1/2005 |
| RU | 2274774 | 4/2006 |

OTHER PUBLICATIONS

Australian Patent Office Examination Report and Search Report, Application No. SG 200704906-7, Date of Mailing Apr. 23, 2008.

* cited by examiner

*Primary Examiner* — Edward Look
*Assistant Examiner* — Jesse Prager
(74) *Attorney, Agent, or Firm* — Jim Patterson

(57) ABSTRACT

A pump stage is disclosed for use with an electrical submersible pump. The stage includes an impeller and diffuser, each having a hub, blades and an outside ring. In such pump stage, the stage flow area is constructed from separate segments manufactured from wear resistant material. Furthermore, each separate segment is retained by the hub using an external compression fit ring.

19 Claims, 9 Drawing Sheets

Section A - A

ELECTRICAL SUBMERSIBLE PUMP STAGE CONSTRUCTION

BACKGROUND

The proposed invention relates to electrical submersible pumps used for hydrocarbons production from oil wells. Pump construction includes a stack of stages placed inside housing. Each stage includes stationary diffuser and rotating impeller. Abrasive solids are present in the production flow in forms of formation rock or proppant grains. Formation solids average concentration in the production flow is 200 mg/liter. In case of heavy oil production this number can be even much higher. Proppant flow back grains concentration in the production flow can reach concentrations as high as 1 g/liter right after fracturing. Production flow speed inside the pump stage for most applications is around 15 m/sec. This high speed causes the stage geometry erosion wear. Solids being trapped inside the stage small gaps between spinning and stationary components cause the stage material abrasion wear as well. As a result pump efficiency is decreasing. Stages wear also leads to the increase of journal bearings dynamic loads. Accelerated radial bearings wear causes pump premature failure.

There are several known technical solutions (analogs) in existence. One of these patents proposes the implementation of iron and boride carbides layers through stage flow area (U.S. Pat. No. 19,830,120). Carbide/boride layers are wear resistant materials. The disadvantage of this technology is surface roughness increase. Consequentially the stage hydraulic characteristics (head and efficiency) are reduced. Diffusion coating technology with wear resistant materials can be used as well. However, due to the limited coating thickness (for diffusion process) eventually it will be worn out with time exposing the base material.

The closest technical solution (prototype 1) to the proposed is a turbodrill stage being described in Russian patent Ns 2244090. Turbodrill is a hydraulic machine used for well drilling. Turbodrill construction comprises a stack of axial type stages (rotor plus stator). Stack of rotors is retained on turbodrill shaft and stator stack is retained inside housing. Working fluid circulated from the surface spins the turbodrill shaft with bit attached. According to this patent the turbodrill stage flow area is fabricated from ceramic using the injection molding process. Flow area is retained to metal hub and outside ring through press fit connection. The presented construction of turbodrill stage is wear resistant and maintains good operation characteristics for a long time. Stage disadvantage is the technological complexity of the complete flow area molding from ceramic material.

The above mentioned disadvantage has been resolved in the construction of turbodrill stage proposed by Russian company "Techbur" (prototype 2) In this design the stage flow area is constructed of separate ceramic segments. Each segment consists of a blade and attached surface. Special filler (epoxy type glue) is used for segments connection to each other and press fit ring retains all segments around the hub. Filler is used as well for gaps filling between the blades. Separate segments manufacturing is much easier process. Filler erosion wear in blade gaps is this construction disadvantage. As a result the stage operational parameters are going to be reduced once the filler starts wearing out. The goal of the proposed invention is pump stage operational life increase by enhancement of stage abrasion and erosion wear properties. The indicated goal is achieved by constructing the flow area of a submersible pump stage from separate segments manufactured from wear resistant material. Segments are retained in the stage construction through compression fit rings.

SUMMARY

The following brief summary refers to various embodied features and is no way intended to unduly limit any present or subsequently related claims in this application.

An electrical submersible pump stage has impeller and a diffuser. Each impeller and diffuser has a hub, blades and an outside ring. The stage flow area is constructed from separate segments manufactured from wear resistant material. The segments are retained to the hub by external compression fit rings. A sleeve made from plastically deformable materials is installed between the hub and the segments and between the ring and the segments.

DETAILED DESCRIPTION

Figure 1:
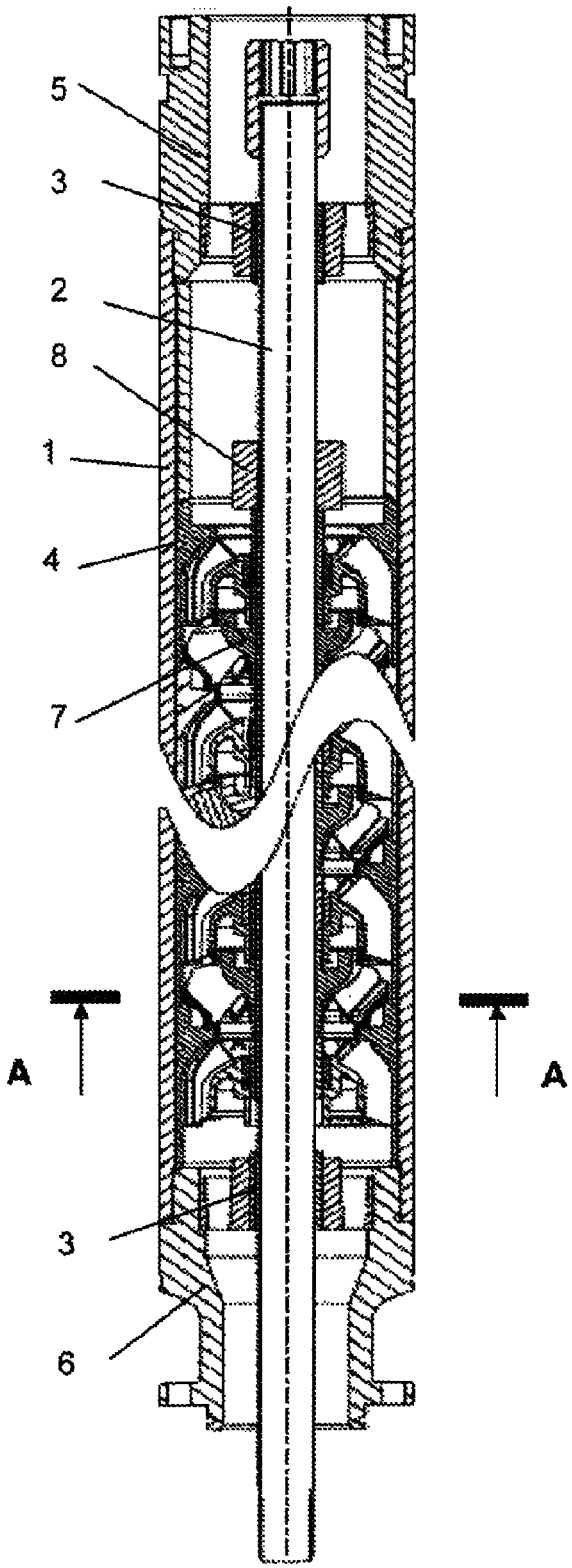
FIG. 1 shows a section view of a pump according to the invention.
Figure 2:
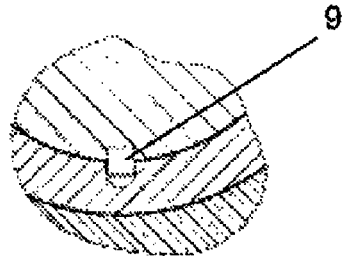
FIG. 2 shows a cross-section on line A-A of FIG. 1.

Electrical Submersible Pump according to the proposed design (FIG. 1) consists off the following main components: housing 1, shaft 2, journal bearings 3, diffusers 4, compressed inside the housing 1 between head 5 and base 6. Impellers 7 have been compressed on the shaft 2 by means of a nut 8. Torque is transmitted from shaft 2 to impeller 7 by means of a rectangular key 9 (FIG. 2).

Figure 3:
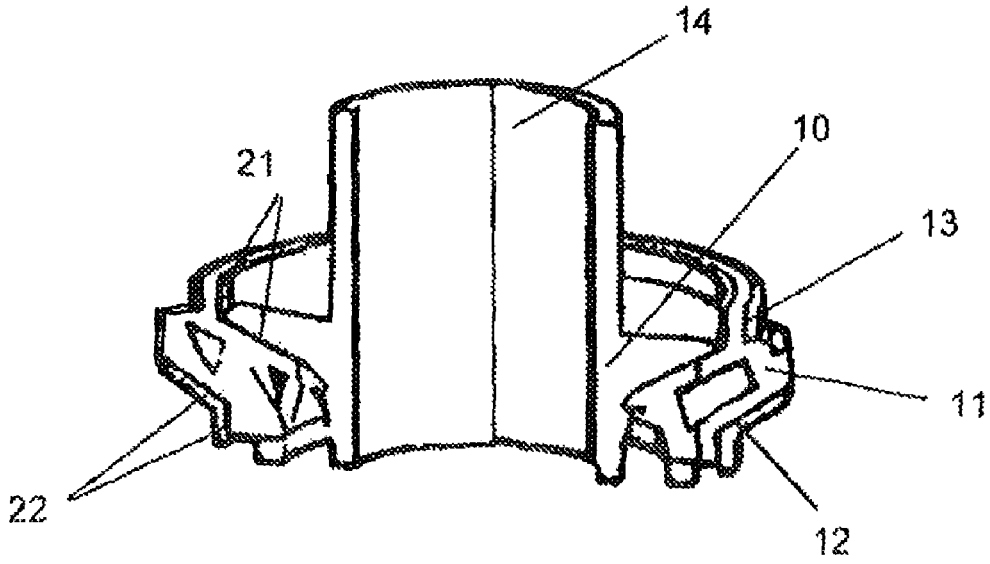
FIG. 3 shows the construction of a pump impeller.
Figure 4:
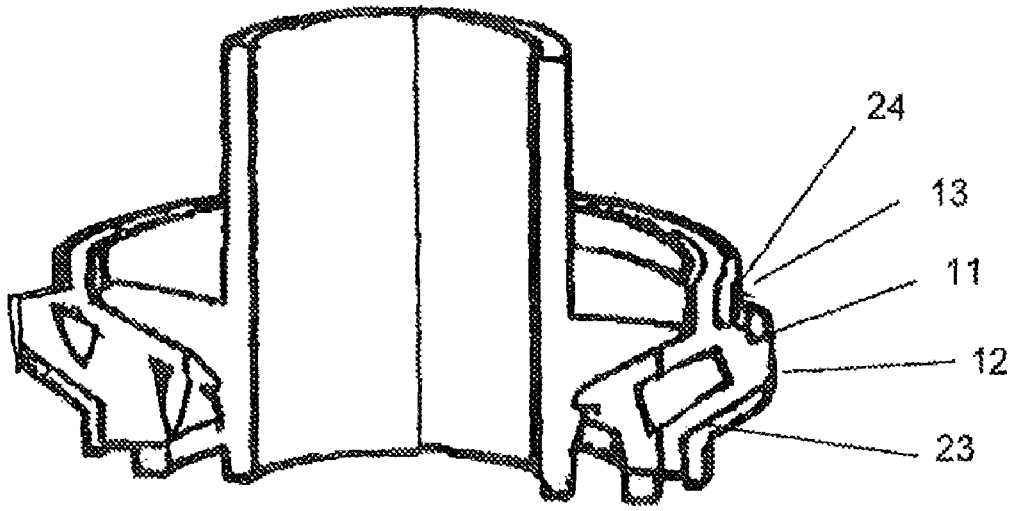
FIG. 4 shows the construction of a pump impeller with deformable sleeves.

Impeller design is explained in FIG. 3 and FIG. 4. Impeller includes hub 10, separate segments 11 located around the hub, cap 12 and external ring 13. Cap 12 and ring 13 connection with segments 11 is press fit. There is a key slot 14 on the hub ID. Segment configuration (FIG. 5) includes blade 15 and adjusting surfaces 16 and 17. Cylindrical extrusion 18 adjoins surface 16. Geometry configuration 19 of segment surface 16 is matching the hub configuration 21 through their contact area (FIG. 3). Geometry configuration 20 of segment surface 17 is matching the configuration 22 of cap 12 through the contact area (FIG. 3). Segments 11 are retained in the impeller through compression load from cap 12 and ring 13. Friction force generated in the connections is sufficient enough for retaining impeller components as one monolithic unit and for torque transmission from the shaft. Segments 11 are being fabricated from wear resistance material with minimum Knoop hardness 500 units. Ceramic and carbides based materials can be used for segment material.

Figure 5:
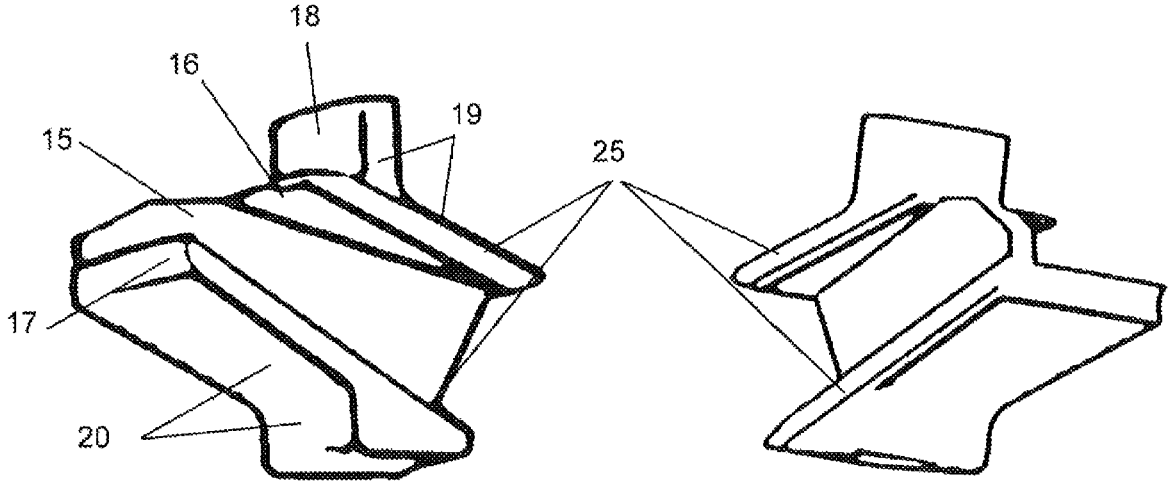
FIG. 5 shows a separate impeller segment design.

Impeller assembly (FIG. 3) is performed in the following way. Segments 11 are being positioned around hub 10. Ring 13 is heated up to fixed temperature. Heating temperature value is determined based on the compression fit load and depends on the coefficient of ring thermal expansion. Once heated up the ring 13 is placed over extrusions 18 of segments 11 (FIG. 5). Ring 13 is cooling down compressing the segments 11 and squeezing them against hub 10. At the next step cap 12 is heated up to the fixed temperature and placed over segments. After cooling cap tightly squeezes segments and presses them against hub. In the proposed impeller construction segments retaining is occurring from both ends. This way the construction robustness has been achieved.

In order to achieve segments reliable retention and to eliminate chances of some segments being loose due to differences in dimensional tolerances one of the proposed construction versions of the design includes thin sleeves manufactured from deformable material (FIG. 4). First sleeve 23 is installed between segment 11 and cap 12. Second sleeve 24 is installed between ring 13 and segment 11. Under squeezing load the sleeves are plastically deformed and load is distributed uniformly through all impeller segments. Copper or material with similar properties can be used for sleeves manufacturing.

Figure 6:
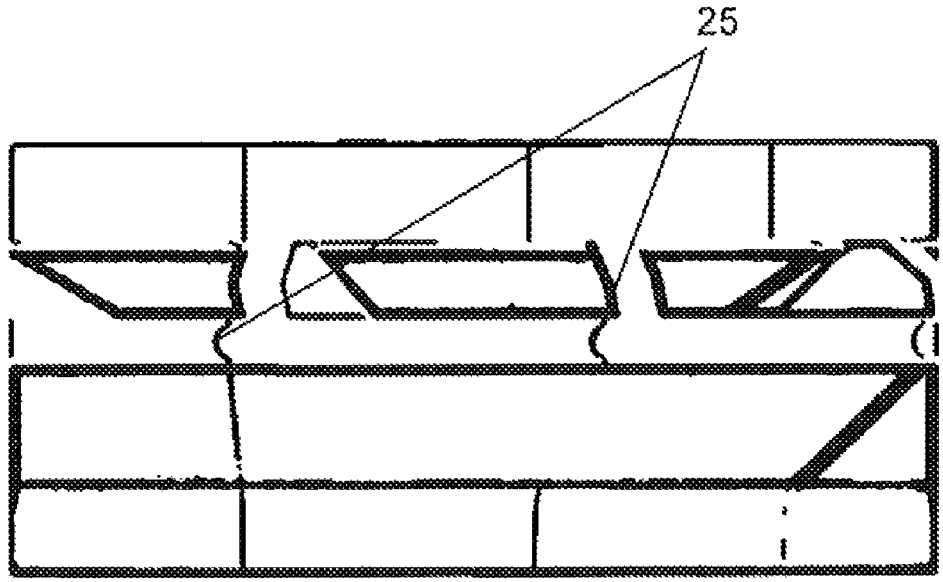
FIG. 6 shows a side connection between segments.

Labyrinth type face seal 25 (FIG. 5 and FIG. 6) fabricated at segments sides is another version of the stage construction. The face seal prevents produced fluid contact with hub and cap surfaces. The face seal is constructed in form of a chevron connection between male and female features at segment sides.

Figure 7:
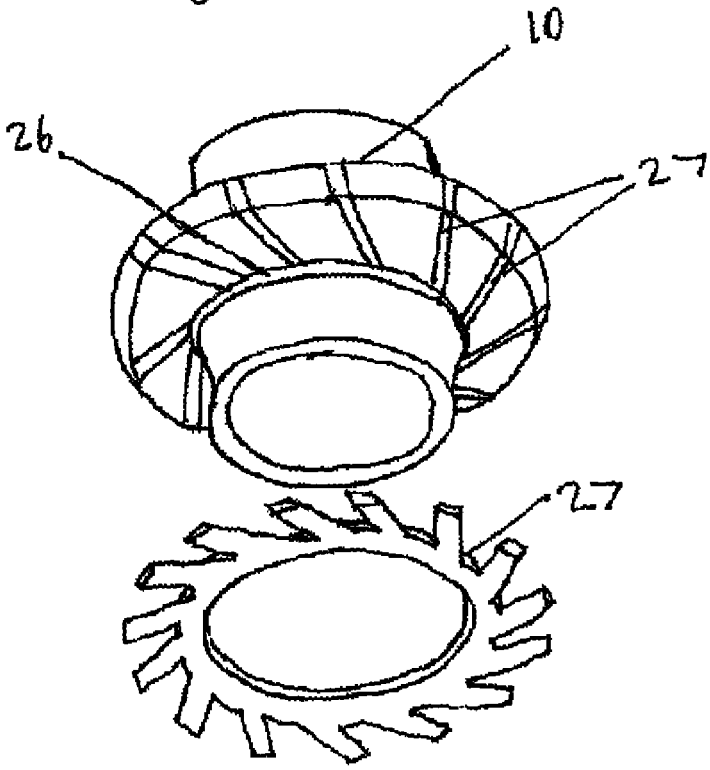
FIG. 7 shows an impeller hub construction with a sealing gasket.
Figure 8:
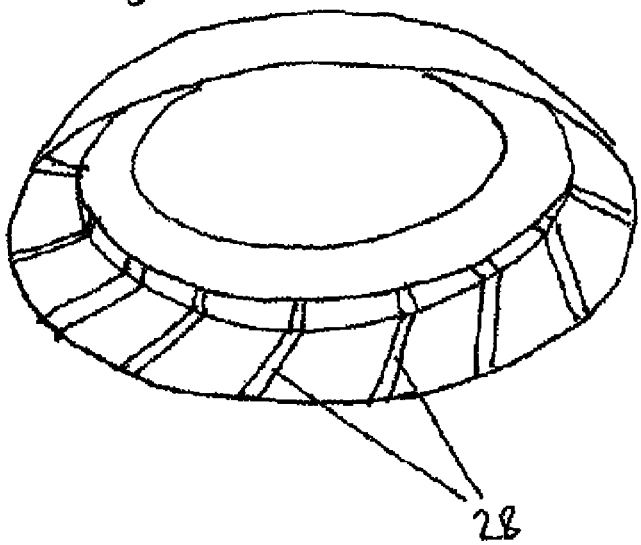
FIG. 8 shows a design of an impeller cap.

In order to block fluid recirculation under the segments the certain impeller design version is proposed. Concentric groove 26 (FIG. 7) with adjusting radial slots 27 in quantity equal to the segments quantity is implemented on the hub surface. Elastomer seal 27 is shown in FIG. 7. Due to cap 12 heating during impeller assembly the elastomer seal can not be placed in contact area between cap and segment. Soft deformable material can be placed in cap slots 28 (FIG. 8).

Figure 9:
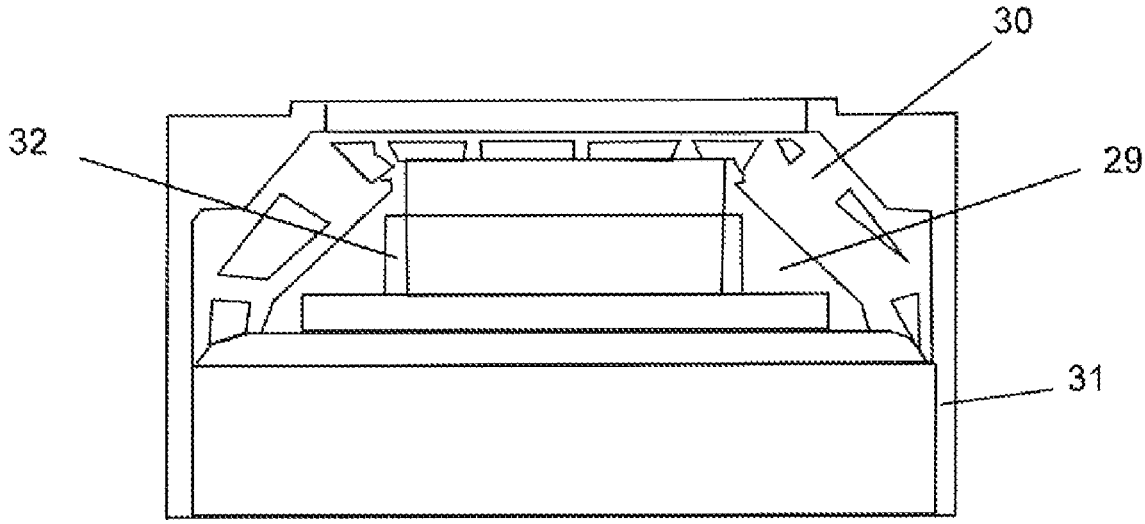
FIG. 9 shows a diffuser construction.
Figure 10:
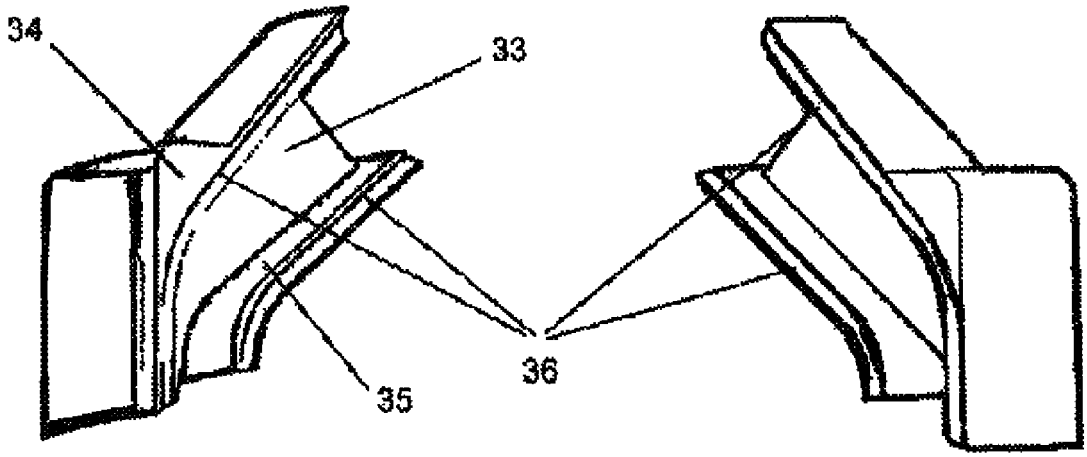
FIG. 10 shows a design of a separate diffuser segment.

Diffuser construction is shown in FIG. 9. Diffuser consists of hub 29, segments 30, external skirt 31 press fit over segments 30 and internal bushing 32. Bushing 32 is press fit in hub 29. Diffuser single segment construction geometry is shown in FIG. 10. The segment consists of blade 33 and adjusting surfaces 34 and 35. The contact surface configuration of 35 matches the geometry of the outside surface of hub 29. The contact surface configuration of 34 matches the configuration of skirt 31 inner surface. Segments 30 and bushing 32 are manufactured from wear resistant material with min Knoop hardness 500. Ceramic or carbide based materials should be used for segments and bushing fabricating.

The diffuser assembly is performed in the following order. Bushing 32 is pressed in hub 29. Segments 30 are positioned around hub 29. Skirt 31 is heated up to the fixed temperature. Heating temperature value is determined based on the compression fit load and depends on the coefficient of skirt thermal expansion. Skirt 31 is placed over segments 30 (FIG. 9). Cooling down the skirt tightly squeezes segments and presses them against the hub.

The chevron type face seal 36 is constructed at the diffuser segment sides (FIG. 10) and prevents hub and skirt surfaces erosion wear. The diffuser face seal configuration is identical to the impeller one, being described above.

Figure 11:
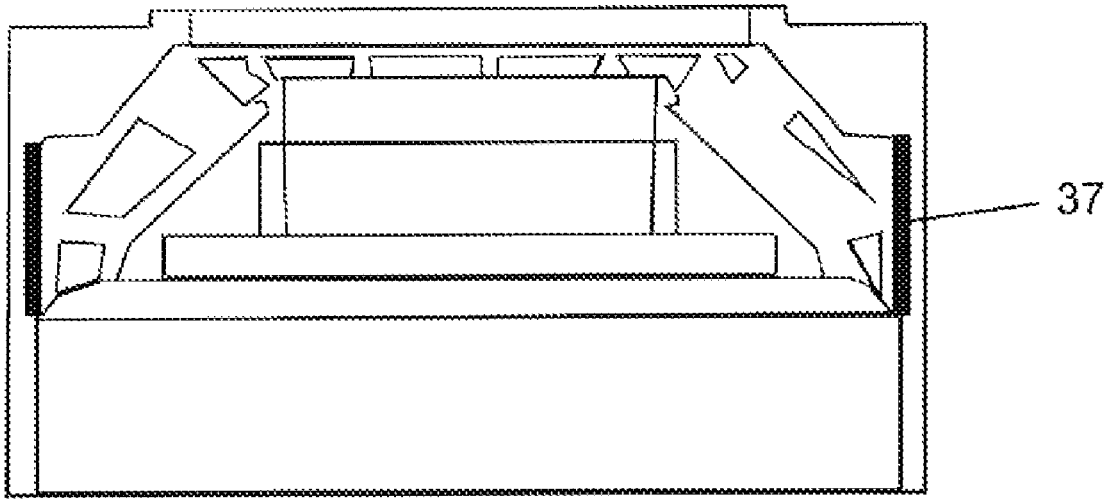
FIG. 11 shows a diffuser design with a deformable sleeve.

In order to achieve diffuser segments reliable retention and to eliminate chances of some segments being loose due to differences in dimensional tolerances one of the proposed versions of the design includes thin deformable sleeve 37 placed between segments and skirt (FIG. 11)

In order to block fluid recirculation under the diffuser segments a deformable seal can be used. The seal design is identical to impeller seal 27 and placed between hub and segments.

Figure 12:
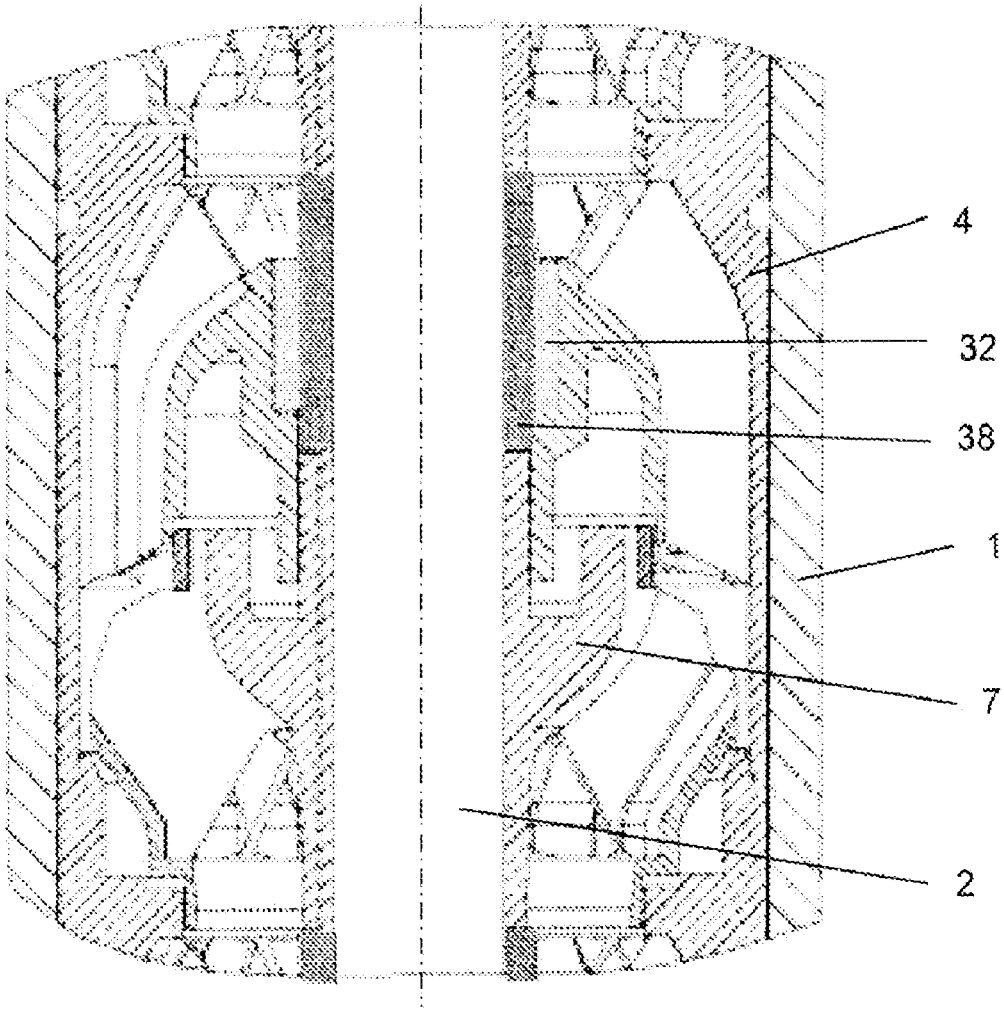
FIG. 12 shows a detailed view of part of a pump section.

A fragment of pumps section with proposed stages is shown in FIG. 12. Diffusers 4 stack is compressed inside housing 1. Impellers 7 with spacers 38 are compressed on shaft 2. Spacer is fabricated from abrasion resistant material. Ceramic or carbide based materials should be used for spacer manufacturing. Spacer 38 and bushing 32 comprises a pump journal bearing. The proposed pump section design is suited for production of hydrocarbons with high content of abrasive solids. The stage flow area is erosion resistant due to the proper material implementation. Each pump stage has a wear resistant journal bearing to prevent stage abrasion wear.

The invention claimed is:

1. An electrical submersible pump stage comprising:

an impeller that comprises an impeller hub, wear resistant bladed impeller segments, a compression fit ring to secure the bladed impeller segments to the impeller hub and a plastically deformable sleeve disposed between the compression fit ring and the bladed impeller segments; and a diffuser that comprises a diffuser hub, wear resistant bladed diffuser segments, a compression fit skirt to secure the bladed diffuser segments to the diffuser hub and a plastically deformable sleeve disposed between the compression fit skirt and the bladed diffuser segments.

2. The stage of claim 1, wherein side interference of two adjacently positioned segments of the bladed impeller segments is constructed in the form of a chevron type face labyrinth seal and wherein side interference of two adjacently positioned segments of the bladed diffuser segments is constructed in the form of a chevron type face labyrinth seal.

3. An electrical submersible pump stage comprising:

an impeller that comprises an impeller hub, wear resistant bladed impeller segments, and a compression fit ring to secure the bladed impeller segments to the impeller hub; and a diffuser that comprises a diffuser hub, wear resistant bladed diffuser segments, a compression fit skirt to secure the bladed diffuser segments to the diffuser hub and a gasket with radial beams disposed between the bladed diffuser segments and the diffuser hub wherein a total number of radial beams equals a total number of bladed diffuser segments for the diffuser.

4. The stage of claim 1, wherein a bushing is made from wear resistant material and is press fit into the diffuser hub.

5. The stage of claim 1 further comprising an impeller cap configured to secure the bladed impeller segments to the impeller hub.

6. The stage of claim 5 wherein the impeller cap comprises a compression fit impeller cap.

7. The stage of claim 5 further comprising a gasket with radial beams disposed between the impeller cap and the bladed impeller segments.

8. The stage of claim 7 wherein a total number of radial beams equals a total number of bladed impeller segments for the impeller.

9. The stage of claim 5 further comprising a plastically deformable sleeve disposed between the impeller cap and the bladed impeller stages.

10. The stage of claim 1 wherein each of the bladed impeller segments comprises a blade disposed between a pair of adjusting surfaces.

11. The stage of claim 1 wherein each of the bladed impeller segments comprises a partial cylinder shaped surface wherein the plastically deformable sleeve disposed between the compression fit ring and the bladed impeller segments abuts each of the partial cylinder shaped surfaces.

12. The stage of claim 1 wherein the compression fit ring comprises material and size characteristics that provide for compression fitting by heating to expand the ring and cooling to contract the ring.

13. The stage of claim 1 wherein the compression fit skirt comprises material and size characteristics that provide for compression fitting by heating to expand the skirt and cooling to contract the skirt.

14. The stage of claim 3 wherein the impeller comprises a plastically deformable sleeve disposed between the compression fit ring and the bladed impeller segments.

15. The stage of claim 3 wherein the diffuser comprises a plastically deformable sleeve disposed between the compression fit skirt and the bladed diffuser segments.

16. The stage of claim 3 further comprising an impeller cap configured to secure the bladed impeller stages to the impeller hub.

17. The stage of claim 16 wherein the impeller cap comprises a compression fit impeller cap.

18. The stage of claim 16 further comprising a gasket with radial beams disposed between the impeller cap and the bladed impeller segments.

19. The stage of claim 18 wherein a total number of radial beams equals a total number of bladed impeller segments for the impeller.

* * * * *